US009309761B2

(12) United States Patent
Wood

(10) Patent No.: US 9,309,761 B2
(45) Date of Patent: Apr. 12, 2016

(54) COMMUNICATION SYSTEM FOR EXTENDED REACH WELLS

(75) Inventor: Edward Wood, Kingwood, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 646 days.

(21) Appl. No.: 13/472,852

(22) Filed: May 16, 2012

(65) Prior Publication Data

US 2013/0306374 A1 Nov. 21, 2013

(51) Int. Cl.
*E21B 47/12* (2012.01)
*E21B 43/30* (2006.01)

(52) U.S. Cl.
CPC ..... *E21B 47/122* (2013.01); *E21B 47/12* (2013.01); *E21B 43/305* (2013.01)

(58) Field of Classification Search
CPC ..... E21B 47/00; E21B 47/12; E21B 47/122
USPC ..... 166/255.1, 255.2
See application file for complete search history.

(56) References Cited

U.S. PATENT DOCUMENTS

| | | | | |
|---|---|---|---|---|
| 4,348,672 | A | 9/1982 | Givler | |
| 5,008,664 | A | 4/1991 | More et al. | |
| 5,887,657 | A | 3/1999 | Bussear et al. | |
| 5,947,213 | A * | 9/1999 | Angle et al. | 175/24 |
| 6,333,700 | B1 * | 12/2001 | Thomeer et al. | 340/854.8 |
| 6,736,210 | B2 | 5/2004 | Hosie et al. | |
| 6,995,683 | B2 | 2/2006 | Smithson et al. | |
| 2006/0086497 | A1 * | 4/2006 | Ohmer et al. | 166/250.01 |
| 2009/0039889 | A1 | 2/2009 | Wilt et al. | |
| 2009/0188665 | A1 | 7/2009 | Tubel et al. | |
| 2012/0056623 | A1 * | 3/2012 | Esmersoy | 324/332 |
| 2013/0168085 | A1 * | 7/2013 | Fraser | 166/250.01 |

OTHER PUBLICATIONS

Lyons, William. "Selection of Drilling Practices." Working Guide to Drilling Equipment and Operations. Gulf Professional, 2009. 313. Print.*

Bjarne Bennetzen et al., "Extended-Reach Wells," Oilfield Review Autumn 2010: 22, No. 3, Copyright @ 2010 Schlumberger, pp. 4-15.

Notification of Transmittal of the International Search Report and the Written Opinion of the International Searching Authority, or the Declaration;PCT/US2013/035441; Jul. 4, 2013. 13 pages.

* cited by examiner

*Primary Examiner* — Nicole Coy
*Assistant Examiner* — Tara Schimpf
(74) *Attorney, Agent, or Firm* — Cantor Colburn LLP

(57) ABSTRACT

A downhole communication system for an extended reach borehole, including an operator unit operatively arranged to enable at least one of remote monitoring or control of at least one device disposed in the extended reach borehole. A first communicator is disposed in a highly deviated extension of the borehole and configured to receive or transmit a signal at least one of from or to the at least one device. A second communicator is included spatially remote from the borehole. The first communicator and the second communicator are located substantially in a vertically extending plane defined along a length of the highly deviated extension. The second communicator is operatively in signal communication with both the first communicator and the operator unit for enabling signal communication between the first communicator and the operator unit via the second communicator. Methods of communicating downhole and completing an extended reach borehole are also included.

19 Claims, 2 Drawing Sheets

COMMUNICATION SYSTEM FOR EXTENDED REACH WELLS

BACKGROUND

In the downhole drilling and completions industry, extended reach wells can be drilled beyond the practical reach of coiled tubing, control lines, and other control and monitoring communication systems. These extended reach wells can have lateral or horizontal reaches that extend well over 10,000 feet, some exceeding even 40,000 feet using current technology. As a result, downhole data important for efficiently performing downhole operations, such as temperature, pressure, flow rate, oil/water ratio, etc. cannot be measured and communicated to surface. Further, downhole devices such as sleeves, chokes, valves, packers, inflow control devices, etc., cannot be remotely controlled by operators at surface. The industry would well receive systems that enable communication for monitoring and controlling devices in extended reach wells and boreholes.

SUMMARY

A downhole communication system for an extended reach borehole, including an operator unit operatively arranged to enable at least one of remote monitoring or control of at least one device disposed in the extended reach borehole; a first communicator disposed in a highly deviated extension of the borehole and configured to receive or transmit a signal at least one of from or to the at least one device; and a second communicator spatially remote from the borehole, the first communicator and the second communicator located substantially in a vertically extending plane defined along a length of the highly deviated extension, the second communicator operatively in signal communication with both the first communicator and the operator unit for enabling signal communication between the first communicator and the operator unit via the second communicator.

A method of completing an extended reach borehole, including arranging a first communicator in the extended reach borehole; arranging a device in the extended reach borehole, the device in signal communication with the first communicator; arranging a second communicator spatially remote from the borehole, the second communicator in signal communication with an operator unit for the borehole; and communicating between the device and the operator unit via the first and second communicators.

A method of communicating downhole in an extended reach borehole, including communicating between an operator unit for the borehole and a first communicator disposed in a highly deviated extension of the borehole via a second communicator, the first communicator substantially in a plane with the second communicator, the plane extending vertically and along the highly deviated extension, the second communicator spatially remote from the borehole.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
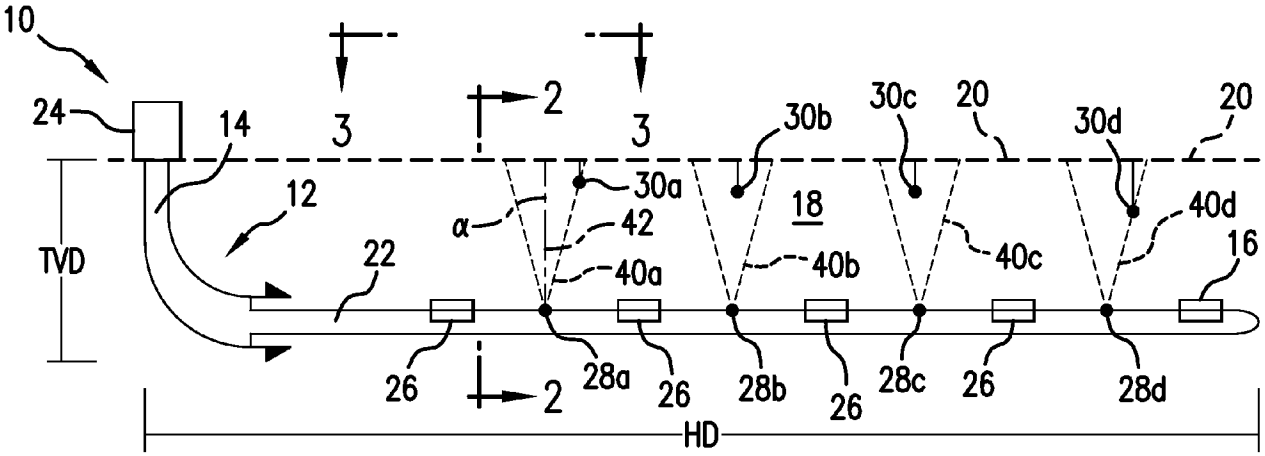
FIG. 1 schematically illustrates downhole communication system for an extended reach borehole.

Referring now to FIG. 1, a communication system 10 is illustrated for enabling communication in a borehole or well 12. In one embodiment the borehole 12 is an extended reach borehole having a vertical section 14 and a highly deviated reach or extension 16. By "highly deviated" it is meant that the extension 16 is drilled significantly away from vertical. The extension 16 may be drilled in a direction that is generally horizontal, lateral, perpendicular to the vertical section 14, etc., or that otherwise approaches or approximates such a direction. For this reason, the highly deviated extension 16 may alternatively be referred to as the horizontal or lateral extension 16, although it is to be appreciated that the actual direction of the extension 16 may vary in different embodiments. A true vertical depth (TVD) of the borehole 12 is defined by the vertical section 14, and a horizontal or deviated depth or displacement (HD) is defined by a length of the extension 16 (as indicated above, the "horizontal" depth may not be truly in the horizontal direction, and could instead be some other direction deviated from vertical), with a total depth of the well equaling a sum of the true vertical depth and the horizontal depth. In one embodiment, the total depth of the well is at least 10,000 feet, which represents a practical limit for coiled tubing and control lines in this type of well. As noted above, the total depth can exceed 40,000 feet. The true vertical depth for typical extended reach wells based on current technology is between about 3,000 and 10,000 feet, although other depths may be used as desired or required, e.g., by geology.

The borehole 12 is formed through an earthen or geologic formation 18 at a surface 20. For example, the formation 18 could be a portion of the Earth e.g., comprising dirt, mud, rock, sand, etc., and the surface 20 could be a portion of the surface of the Earth either onshore or below a body of water. In one embodiment, the surface 20 is in an ocean seabed, i.e., the mudline. A tubular string 22 is installed through the borehole 12, e.g., enabling the production of fluids such as hydrocarbons. In the illustrated embodiment, a control, monitor, or, operator unit 24 is located at or proximate to the mouth, entry, or wellhead of the borehole 12. For example, the unit 24 could be, include, or be included with a wellhead, a drill rig, operator consoles, associated equipment, etc., that enable control and/or observation of downhole tools, devices, parameters, conditions, etc. Regardless of the particular embodiment, operators of the system 10 are in signal and/or data communication with the unit 24, e.g., with various computing devices, control panels, display screens, monitoring systems, etc. known in the art. Of course, a monitor, control, or operator unit could be located in other locations for enabling the downhole control and/or observation noted above (for example, as discussed in more detail below with respect to FIGS. 4 and 5).

A plurality of devices 26 is included along the length of the borehole 12. The devices 26 are illustrated schematically and could include any combination of tools, devices, components, or mechanisms that are arranged to receive and/or transmit signals to facilitate any phase of the life of the borehole 12, including, e.g., drilling, completion, production, etc. For example the devices 26 could include sensors (e.g., for monitoring pressure, temperature, flow rate, water and/or oil composition, dielectric or resistance properties of borehole fluids, etc.), chokes, valves, sleeves, inflow control devices, packers, or other actuatable members, etc., or a combination including any of the foregoing. For example, in one embodiment the devices 26 are packers that can be remotely set by the operator unit 24 for a cementing operation. The devices 26 may further comprise sensors for monitoring such a cementing operation. Of course any other operation, e.g., fracing, producing, etc. could be monitored or devices used for these operations controlled.

In traditional wells, the total depth is such that wireless and/or wired communication is feasible even at the most remote locations in those wells. However, with extended reach wells, it is impossible or impractical based on current technology to communicate with vastly remote locations, such as those at the end, or even the middle, of a 40,000 foot extended reach horizontal or near horizontal borehole. For most situations, about 10,000 feet presents a practical limit for running coiled tubing, control lines, or other communication systems in such boreholes. Advantageously, the current invention as disclosed herein enables signal communication between devices, units, communicators, etc., (e.g., between the devices 26 and the unit 24) that would not have been able to communicate using systems known prior to the current invention.

One or more downhole communicators 28 are also provided along the string 22 for bridging the communication gap between the devices 26 and the unit 24. The communicators 28 are individually labeled as the communicators 28*a*, 28*b*, 28*c*, etc. The communicators 28 are illustrated schematically and could comprise any arrangement, assembly, system, etc. for enabling communication through the earth 18. For example, the communicators 28 could include transmitters, receivers, transceivers, antennae, electrode arrays, electric coils, etc. for communicating electromagnetically through the earth 18. The communicators 28 could be arranged according to any known electromagnetic (EM) telemetry techniques, e.g., running current through at least a portion of the tubular string 22 and the earth 18 for completing a circuit and enabling signals in the form of current pulses or the like to be picked up and decoded, interpreted, or converted into data. Any number of the devices 26 and/or communicators 28 could be included along the borehole 12 and the system 10 in FIG. 1 is illustrated to provide one example only. In one embodiment, ones of the devices 26 are integrated with ones of the communicators 28. A power source, e.g., a battery, stray energy collector, fuel cell, chemical composition reactive to downhole fluids or conditions, etc., may be included for powering the devices 26, and/or the communicators 28 and 30.

In order to overcome the issues of extended reach boreholes and enable communication between the unit 24, which is accessible by operators at surface, and the devices 26 in the borehole 12, the system 10 includes one or more surface communicators 30 at, or proximate to, the surface 20 (the communicators 30 individually labeled as the communicators 30*a*, 30*b*, 30*c*, etc.). Although remote from the control/monitoring unit 24 in the illustrated embodiment, since the communicators 30 are located at or proximate to the surface 20, it is a relatively easy prospect to enable communication with operators and/or the assembly 24, via wired or wireless systems, e.g., laying a cable across a seabed. Even if the surface communicators 30 are buried some depth into the surface 20 (to protect the communicators, to establish a better link with the downhole communicators 28, etc.), it is still relatively simple and inexpensive to do so compared to miming a control line or some other communication system tens of thousands of feet. Thus, while spatially remote from the borehole 12 (e.g., not positioned at the wellhead or mouth of the borehole 12), the communicators 30 are relatively easily installed and can communicate with both the downhole devices 26 (via the downhole communicators 28) and the surface control/monitoring unit 24, thereby enabling the desired control and monitoring of downhole operations.

In the illustrated embodiment, the communicators 28 and 30 are arranged in pairs, i.e., with the communicator 28*a* corresponding to the communicator 30*a*, the communicator 28*b* corresponding to the communicator 30*b*, etc. Such pairs may not be utilized in other embodiments, although the arrangement of the communicators 28 and 30 in pairs permits the formation of a relatively short communication path for ensuring better communication therebetween, as discussed in more detail below. The devices 26 could correspond to one or more of the pairs of the communicators 28 and 30, or one or more of the devices could correspond to each pair of the communicators 28 and 30 for ultimately enabling communication between the downhole devices 26 and the control/monitoring unit 24.

In one exemplary embodiment, the devices 26 include one or more packers and one or more sensors associated therewith. The sensors could be used to inform borehole operators of downhole conditions proximate each of the packers. If conditions meet certain criteria, it may be desirable to leave certain ones of the packers un-actuated, e.g., so as not to block off hydrostatic pressure. If downhole conditions meet other criteria, it may be desirable to pack off certain zones or intervals and the operators can utilize the communicators 28 and 30 to send signals from the operator unit 24 to actuate selected ones of the packers. Thus, the current invention can be used to enable operators to selectively pack off specified downhole zones or areas as desired in real time in response to downhole conditions. Another example includes a cementing operation in an extended reach well, where the downhole devices 26, in the form of sensors, relay information regarding cement pressure and the like. Of course, combinations of these and other uses could be employed, e.g., the aforementioned selective packer embodiment could be strategically used in a cementing operation to provide efficient cementation down the length of the borehole 12.

Figure 2:
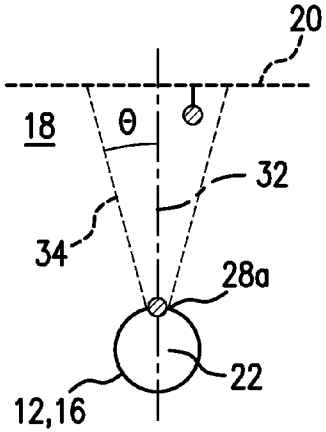
FIG. 2 is a cross-sectional view of the system taken generally along the line 2-2 in FIG. 1.
Figure 3:
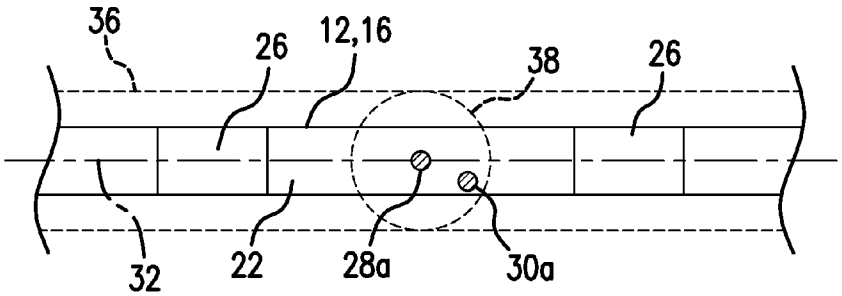
FIG. 3 is a top view of the system taken generally along the line 3-3 in FIG. 1.

The communicators 30 are positionable with respect to the downhole communicators 28 so that a distance therebetween is sufficiently short for enabling communication through the earth 18, e.g., via EM telemetry. Locations for positioning the communicators 30 can be better appreciated with respect to FIGS. 1-3. In FIGS. 2 and 3 it can be seen that a plane 32 is defined by the horizontal extension 16 of the borehole 12. Alternatively stated, the plane 32 extends both along the length of the extension 16 and vertically, as shown. Ideally, placing the communicators 30 at the shortest possible distance from corresponding ones of the communicators 28 should establish the best communication signal therebetween. In most instances, this will be with both the communicators 28 and 30 in the plane 32, with the communicators 30 located directly vertically above the communicators 28. It is inevitable, however, that some degree of deviation or misalignment will occur, e.g., the surface 20 is not flat, the location of the horizontal extension 16 from the perspective of the surface 20 can only be calculated, detected, or determined within some margin of error, a natural feature in the earth 18 impedes EM telemetry or other signal propagation, etc. Even taking these considerations into account, according to the current invention the communicators 28 and the communicators 30 are to be placed substantially in the plane 32. By "substantially in" the plane 32 it is meant that the communicators 28 and 30 are arranged in the plane 32 or are otherwise flanking the plane 32, adjacent to or proximate the plane 32, e.g., for any of the reasons discussed above. Further guidance on positioning the communicators 30 with respect to the communicators 28 is given below.

In accordance with the embodiments illustrated in FIGS. 1-3, the communicators 30 can be positioned within some volume defined by the communicators 28 (and/or the borehole 12). For example, in FIGS. 2 and 3 it can be seen that a triangular prism-shaped volume 34 is formed having an apex defined as a line in the plane 32 connecting through the downhole communicators 28 (that is, extending horizontally along the extension 16 of the borehole 12). A base of the triangular prism-shaped volume 34 is located at the surface 20, namely, taking the shape of a rectangular area 36 shown in FIG. 3. Also defining the volume 34 is an angle θ at the apex (i.e., at the downhole communicators 28), which sets the dimensions of rectangular area 36 that defines the base of the volume 34. The angle θ is set with respect to one or more vertical lines or axes that are located in the plane 32 and extend from the apex, e.g., the downhole communicators 28. It is noted that the angle θ may also correspond to a circular area 38 that enables even more precise alignment between the downhole communicators 28 and the surface communicators 30, as discussed below. By positioning the communicators 30 within the volume 34, communication between the downhole communicators 28 and the control and/or monitoring assembly 24 can be reliably established. In preferred embodiments, the angle θ should be at most about 15 degrees in order to ensure proper communication between the downhole and surface communicators 28 and 30, while also enabling adjustments or deviations to be made, e.g., due to the particular geometry encountered, or the other factors discussed above.

According to FIGS. 1 and 3, it can be seen that a cone-shaped volume 40 is formed corresponding to each of the communicators 28 (the volume 40*a* corresponding to the communicator 28*a*, the volume 40*b* corresponding to the communicator 28*b*, etc.). The volumes 40 form a subset of the prism-shaped volume 36, each having a base defined by the circular area 38, thus providing more precise alignment between the communicators 28 and 30. As one specific example, an apex for the cone-shaped volume 40*a* is set at the communicator 28*a*, and a base of the volume 40*a* is defined at the surface 20 by the circular area 38*a*. An angle α, arranged in a plane perpendicular to that of the plane 32, can be used to describe the cone-shaped volume 40*a* (e.g., rotating the angle α about a vertical axis 42 positioned in the plane 32 and extending from the communicator 28*a*). Alternatively, the angle θ could be similarly used to define the areas 38. In one embodiment, the areas defining the base of the volumes could be ellipsoidal using both the angles α and θ, or they could be some other shape. The volumes 40*b*, 40*c*, etc. for the other communicators 28 can be determined similarly to the above. In preferred embodiments, the angle α should be at most about 15 degrees.

Figure 4:
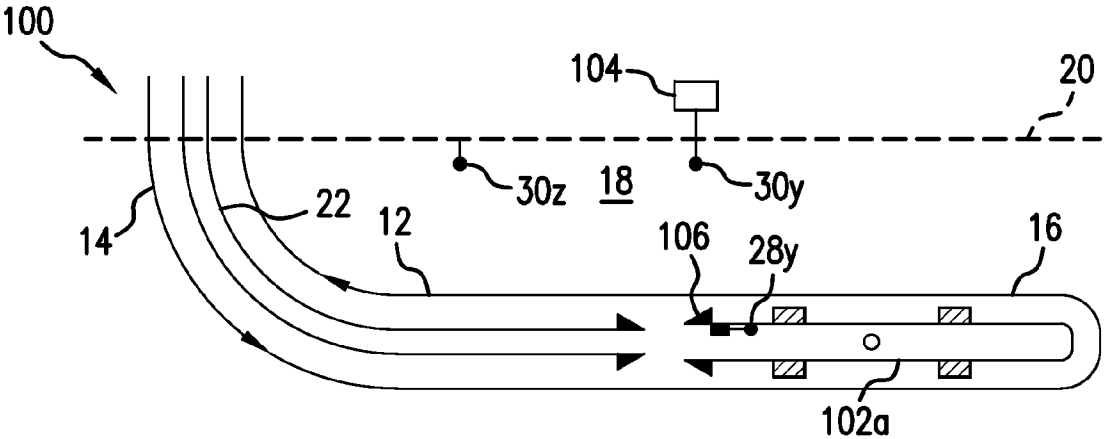
FIG. 4 schematically depicts a system according to another embodiment disclosed herein.
Figure 5:
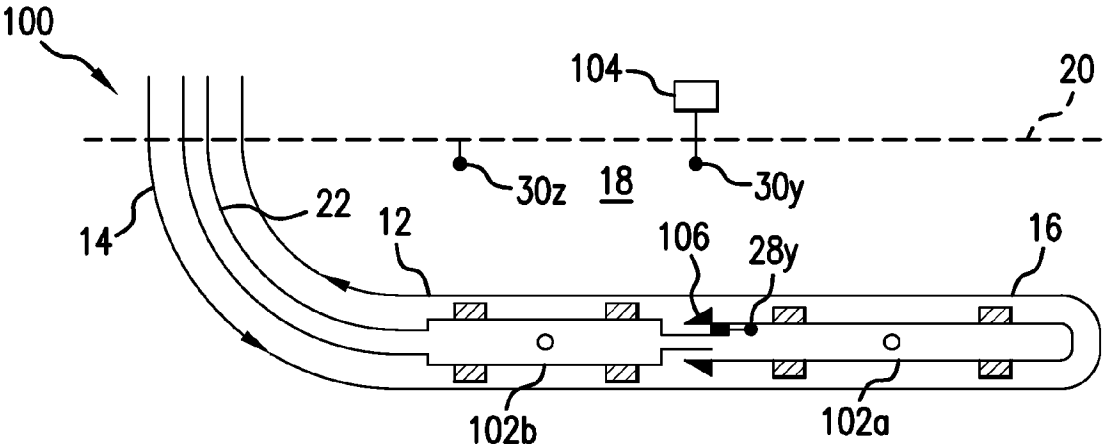
FIG. 5 schematically depicts the system of FIG. 4 having a first scab liner engaged with a second scab liner.

It is not feasible to case an extended reach borehole by traditional methods because frictional forces on the liner become insurmountably high when inserting the liner into the borehole. In other words, liners are too heavy to push tens of thousands of feet into a borehole. A system 100 according to one embodiment is disclosed in FIGS. 4 and 5 that enables the borehole 12 to be cased. In this embodiment, relatively short liner sections or scab liners 102 are inserted into the borehole 12 via the tubular string 22, which could be a work string, a drill string, etc. In FIG. 4, a first scab liner 102*a* is shown at the end of the horizontal or deviated section 16 of the borehole 12. After being positioned in its desired location, the string 22 can be removed.

Once the string 22 is removed, the scab liner 102*a* is entirely disconnected from the string 22, and thus communication with the liner 102*a* is not possible by conventional means. Accordingly, the liner 102*a* is equipped with a downhole communicator 28*y* that enables communication with a surface communicator 30*y* (the communicators 28*y* and/or 30*y* being arranged according to the description given above with respect to FIGS. 1-3). Thus, advantageously, the current invention enables communication downhole even if the component with which the communicator 28 and/or the device 26 is physically disconnected from the wellhead, such as shown in FIG. 4. In the embodiment illustrated in FIG. 4, a monitor, control, and/or operator unit 104 is positioned at the surface 20. The unit 104 generally resembles the unit 24 discussed above, i.e., communicating downhole for enabling the control and/or monitoring of downhole devices, but is located remotely from the wellhead or mouth of the borehole. By aligning the unit 104 generally along the plane 32, but remote from the wellhead, shorter cables or less robust wireless assemblies can be used to communicate with neighboring communicators (e.g., the communicator 30*y*, an adjacent surface communicator 30*z*, etc.), as opposed to running cables or relaying wireless signals all the way back to the wellhead.

If it is desired to case the entire length of the borehole 12, a subsequent scab liner or liner section, e.g., a second scab liner 102*b*, can be inserted into the borehole 12 and engaged with the first scab liner 102*a*. The string 22 can be removed and this process can be repeated dozens or even hundreds of times as needed, e.g., to fully case or line the entire length of the borehole 12 starting from the end of the borehole and working back toward the wellhead or mouth.

Since the scab liners or liner sections, e.g., 102*a* and 102*b*, could be thousands or tens of thousands of feet along the borehole 12, it can be difficult if not impossible for operators at surface to accurately engage the liners. For example, an operator may not be able to determine whether engagement between the liners 102*a* and 102*b* has occurred, or whether the string 22 or the subsequent liner 102*b* has become stuck on or blocked by an obstruction in the borehole 12. Advantageously according to the embodiment of FIGS. 4 and 5, the scab liners 102*a* and/or 102*b* are equipped with a mechanism 106 that detects when engagement has been made. For example, the mechanism 106 could be a simple electromechanical latch that is pressed in or triggered by the second liner 102*b* when it is inserted into the first liner 102*a*. Of course, the liner sections could include a variety of other detectors or sensors installed in one or both of the liner sections to be engaged for establishing that engagement between the two liner sections has been achieved. For example, the mechanism 106 could alternatively include: an RFID tag and reader; a magnetic field producing element (e.g., permanent magnet) and magnetic latch or magnetic field sensor (e.g., a Hall effect sensor); a motion detector; a light source and photosensor; etc. A power source, e.g., a battery, stray energy collector, fuel cell, chemical composition reactive to downhole fluids or conditions, etc., may be included in the scab liners 102 for powering the mechanisms 106, the communicator 30*y*, etc. Once engagement is detected by the mechanism 106, a signal is sent to the downhole communicator 28*y*, which is integrated with or otherwise coupled to the mechanism 106. The signal is then relayed by the communicator 28*y*, through the earth 18 to the surface communicator 30*y*, and from the communicator 30*y* to the operator unit 104, e.g., where an operator can receive audiovisual or other verification that the liners are engaged.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A downhole communication system for an extended reach borehole, comprising:

an operator unit operatively arranged to enable at least one of remote monitoring or control of two or more devices disposed in the extended reach borehole;

a plurality of first communicators disposed in a highly deviated extension of the borehole and configured to receive or transmit a signal at least one of from or to at least one of the two or more devices; and a plurality of second communicators spatially remote from the borehole, wherein each one of the plurality of first communicators is paired with a corresponding one of the plurality of second communicators to form a plurality of pairs, such that each pair of the plurality of pairs is located separate from the other pairs of the plurality of pairs, wherein each pair of a first communicator and a second communicator is located substantially in a vertically extending plane defined along a length of the highly deviated extension, the second communicator operatively in signal communication with both the first communicator and the operator unit for enabling signal communication between the first communicator and the operator unit via the second communicator, wherein the second communicator of each pair is located within one of (i) a triangular prism-shaped volume, a base of the triangular prism-shaped volume defined by a surface in which the borehole is formed and an apex of the triangular prism-shaped volume is defined as a line extending through the corresponding first communicator along the highly deviated extension of the borehole and (ii) a cone-shaped volume, a base of the cone-shaped volume defined by a surface in which the borehole is formed and an apex of the cone-shaped volume defined by a location of the corresponding first communicator, wherein at least one pair of communicators is configured for selective communication with and operation of at least one of the two or more devices disposed in the extended reach borehole, wherein each of said volumes containing the second communicator for each of the plurality of pairs does not substantially overlap and wherein the first and second communicators in each of the plurality of pairs only directly communicates with the corresponding communicator in that pair.

2. The system of claim 1, wherein an angle of the triangular prism-shaped volume at the apex is at most 15 degrees with respect to a vertical axis that is in the plane and extends from the apex.

3. The system of claim 1, wherein an angle defining the cone-shaped volume at the apex is at most 15 degrees with respect to a vertical axis that is in the plane and extends from the apex.

4. The system of claim 1, wherein the plurality of first communicators are located more than 15,000 feet from a wellhead of the borehole.

5. The system of claim 1, wherein a total vertical depth of the borehole is between about 3,000 feet and 10,000 feet.

6. The system of claim 1, wherein each first communicator, each second communicator, or both comprise a transmitter, a receiver, or a combination including at least one of the foregoing.

7. The system of claim 1, wherein each first communicator and second communicator pair communicate via EM telemetry.

8. The system of claim 1, wherein each of the devices comprise a packer, a sleeve, a choke assembly, a valve, a sensor, an inflow control device, or a combination including at least one of the foregoing.

9. The system of claim 1, wherein the operator unit is proximate a mouth or wellhead of the borehole.

10. The system of claim 1, wherein the operator unit is spatially remote from the borehole.

11. The system of claim 1, wherein at least one of the plurality of first communicators and one of the devices are disposed with a component in the borehole that is physically disconnected from a wellhead of the borehole.

12. A method of communicating downhole in an extended reach borehole, comprising:

communicating between an operator unit for the borehole and a plurality of first communicators disposed in a highly deviated extension of the borehole via a plurality of paired second communicators, wherein each one of the plurality of first communicators is paired with a corresponding one of the plurality of second communicators, the plurality of first communicators located substantially in a plane with the plurality of second communicators, the plane extending vertically and along the highly deviated extension, the second communicators spatially remote from the borehole, the first and second communicators paired and configured such that each pair of the first communicators and second communicators is located separately from the other pairs of the plurality of pairs, wherein the second communicator of each pair is located within one of (i) a triangular prism-shaped volume, a base of the triangular prism-shaped volume defined by a surface in which the borehole is formed and an apex of the triangular prism-shaped volume is defined as a line extending through the corresponding first communicator along the highly deviated extension of the borehole and (ii) a cone-shaped volume, a base of the cone-shaped volume defined by a surface in which the borehole is formed and an apex of the cone-shaped volume defined by a location of the corresponding first communicator, wherein at least one pair of communicators is configured for selective communication with and operation of a device disposed in the extended reach borehole, and wherein each of said volumes containing the second communicator for each of the plurality of pairs does not substantially overlap and wherein the first and second communicators in each of the plurality of pairs only directly communicates with the corresponding communicator in that pair.

13. The method of claim 12, first comprising defining a plane extending vertically and along the highly deviated extension and disposing each of the first communicators and the second communicators substantially in the plane.

14. A method of completing an extended reach borehole, comprising:

arranging a plurality of first communicators in the extended reach borehole;

arranging two or more devices in the extended reach borehole, the devices in signal communication with at least one of the first communicators;

arranging a plurality of second communicators spatially remote from the borehole and spatially remote from each other, the second communicators in signal communication with an operator unit for the borehole, wherein each one of the plurality of first communicators is paired with a corresponding one of the plurality of second communicators, such that each pair of the plurality of pairs is located separately from the other pairs of the plurality of pairs; and communicating between the device and the operator unit via the first and second communicators, wherein the second communicator of each pair is located within one of (i) a triangular prism-shaped volume, a base of the triangular prism-shaped volume defined by a surface in which the borehole is formed and an apex of the triangular prism-shaped volume is defined as a line extending through the corresponding first communicator along the highly deviated extension of the borehole and (ii) a cone-shaped volume, a base of the cone-shaped volume defined by a surface in which the borehole is formed and an apex of the cone-shaped volume defined by a location of the corresponding first communicator, wherein at least one pair of communicators is configured for selective communication with and operation of at least one of the two or more devices disposed in the extended reach borehole, and wherein each of said volumes containing the second communicator for each of the plurality of pairs does not substantially overlap and wherein the first and second communicators in each of the plurality of pairs only directly communicates with the corresponding communicator in that pair.

15. The method of claim 14, wherein at least one of the devices is a sensor arranged to monitor pressure, temperature, borehole fluid resistance or dielectric characteristics, water percentage or cut, or a combination including at least one of the foregoing, and communicating between the device and the operator unit includes sending data from the sensor to at least one first communicator to at least one second communicator to the operator unit.

16. The method of claim 14, wherein at least one of the devices is a packer or actuatable member, and communicating between the device and the operator unit includes sending a signal from the operator unit to at least one second communicator to at least one first communicator to the device, the method further comprising triggering actuation of the device with the signal.

17. The method of claim 14, wherein at least one of the devices is a sensor or measurement device, and communicating between the device and the operator unit includes sending a signal from the operator unit to at least one second communicator to at least one first communicator to the device, the method further comprising measuring at least one parameter or condition with the device in response to receiving the signal, sending data regarding the at least one parameter or condition to at least one first communicator for communication to the operator unit via at least one second communicator, or a combination including at least one of the foregoing.

18. The method of claim 14, wherein at least one of the devices is a mechanism operatively arranged to detect engagement between a first liner section and a second liner section, the method further comprising positioning a first liner section in the borehole, engaging a second liner section with the first liner section, and detecting engagement of the first and second liner sections with the mechanism.

19. The method of claim 14, wherein communicating between at least one of the devices and the operator unit via at least one first and second communicators occurs while the device and at least one first communicator are disposed with a component located in the borehole that is physically disconnected from a wellhead of the borehole.

* * * * *